US008683752B1

(12) United States Patent
Gonzalez

(10) Patent No.: US 8,683,752 B1
(45) Date of Patent: Apr. 1, 2014

(54) MODULAR SHELTER ASSEMBLY

(76) Inventor: Orlando Gonzalez, Miami, FL (US)

( * ) Notice: Subject to any disclaimer, the term of this patent is extended or adjusted under 35 U.S.C. 154(b) by 0 days.

(21) Appl. No.: 13/466,515

(22) Filed: May 8, 2012

Related U.S. Application Data

(63) Continuation-in-part of application No. 13/216,886, filed on Aug. 24, 2011.

(51) Int. Cl.
*E04B 1/34* (2006.01)

(52) U.S. Cl.
USPC ..... 52/74; 52/69; 160/54; 160/59; 160/82

(58) Field of Classification Search
USPC ..... 52/68, 69, 71, 72, 73, 74, 75, 76, 77, 52/78; 160/48, 49, 54, 59, 78, 79, 81, 82, 160/47, 65, 64, 74
See application file for complete search history.

(56) References Cited

U.S. PATENT DOCUMENTS

| | | | | | |
|---|---|---|---|---|---|
| 415,102 | A | * | 11/1889 | Fullerton | 160/70 |
| 602,772 | A | * | 4/1898 | Richards | 160/69 |
| 1,050,340 | A | * | 1/1913 | Christian | 160/69 |
| 1,050,341 | A | * | 1/1913 | Christian | 160/69 |
| 1,170,188 | A | * | 2/1916 | Rasmussen et al. | 135/149 |
| 1,212,619 | A | * | 1/1917 | Foord | 160/56 |
| 1,228,668 | A | * | 6/1917 | Hanauer | 160/65 |
| 1,230,244 | A | * | 6/1917 | Walger | 160/56 |
| 1,246,601 | A | * | 11/1917 | Howe | 160/70 |
| 1,250,239 | A | * | 12/1917 | Staehelin | 160/56 |
| 1,314,474 | A | * | 8/1919 | Jones | 454/197 |
| 1,549,037 | A | * | 8/1925 | Williams | 160/65 |
| 1,591,339 | A | * | 7/1926 | Staehelin | 160/56 |
| 1,620,958 | A | * | 3/1927 | Girton et al. | 160/65 |
| 1,688,776 | A | * | 10/1928 | Barber | 160/65 |
| 1,749,197 | A | * | 3/1930 | Lenard | 160/68 |
| 1,777,778 | A | * | 10/1930 | Zecher | 160/10 |
| 1,855,376 | A | * | 4/1932 | Anton | 160/65 |
| 1,882,425 | A | * | 10/1932 | Kasan | 160/64 |
| 2,201,887 | A | * | 5/1940 | De Bord | 160/77 |
| 2,276,550 | A | * | 3/1942 | Skyum | 160/65 |
| 2,565,545 | A | * | 8/1951 | Card | 160/58.1 |
| 2,583,663 | A | * | 1/1952 | Obenchain | 160/76 |
| 2,785,445 | A | * | 3/1957 | Phillips | 49/71 |
| 2,787,321 | A | * | 4/1957 | Dietz | 160/47 |
| 2,865,589 | A | * | 12/1958 | D Azzo | 248/284.1 |
| 2,986,150 | A | * | 5/1961 | Torian | 52/63 |
| 3,146,864 | A | * | 9/1964 | Nystrom et al. | 52/93.2 |
| 3,158,961 | A | * | 12/1964 | Hawkins | 52/395 |
| 3,352,070 | A | * | 11/1967 | Raynes | 52/22 |
| 3,457,689 | A | * | 7/1969 | Troutner | 52/639 |
| 3,470,662 | A | * | 10/1969 | Kellman | 52/99 |
| 3,720,438 | A | * | 3/1973 | Johnson et al. | 135/88.1 |
| 3,763,606 | A | * | 10/1973 | Rindebong | 52/64 |
| 3,785,108 | A | * | 1/1974 | Satchell | 52/645 |

(Continued)

*Primary Examiner* — William Gilbert
*Assistant Examiner* — James Ference
(74) *Attorney, Agent, or Firm* — Malloy & Malloy, P.L.

(57) ABSTRACT

A modular shelter assembly is presented. In particular, the shelter assembly comprises a mounting member structured to be secured to a predetermined support, a support beam outwardly spaced from the mounting member and the predetermined support, a plurality of track beams each disposed in interconnecting, supported relation to the mounting member and the support beam, the mounting member, the support beam and the plurality of track beams collectively comprising a modular construction, and the modular construction at least partially defined by an at least initially adjustable interconnecting relation of the plurality of track beams to both the mounting member and the support beam.

17 Claims, 7 Drawing Sheets

(56) References Cited

U.S. PATENT DOCUMENTS

| | | | | | |
|---|---|---|---|---|---|
| 3,789,903 | A | * | 2/1974 | Clark et al. | 135/88.12 |
| 3,800,484 | A | * | 4/1974 | Marshall | 52/69 |
| 3,923,074 | A | * | 12/1975 | McKee | 160/22 |
| 3,971,185 | A | * | 7/1976 | Hendrich | 52/745.14 |
| 3,982,361 | A | * | 9/1976 | Deutsch et al. | 52/80.1 |
| 4,056,902 | A | * | 11/1977 | Ziegler, Jr. | 52/73 |
| 4,077,419 | A | * | 3/1978 | Lux | 160/68 |
| 4,170,852 | A | * | 10/1979 | Danis, Jr. | 52/71 |
| 4,219,982 | A | * | 9/1980 | Hart | 52/641 |
| RE31,234 | E | * | 5/1983 | Jureit et al. | 403/163 |
| 4,422,491 | A | * | 12/1983 | Cusick, III | 160/58.1 |
| 4,571,897 | A | * | 2/1986 | Kerr | 52/13 |
| 4,640,332 | A | * | 2/1987 | Turner | 160/46 |
| 4,765,103 | A | * | 8/1988 | Clarke | 52/86 |
| 4,768,317 | A | * | 9/1988 | Markham | 52/74 |
| 4,773,192 | A | * | 9/1988 | Andrews | 52/93.1 |
| 5,094,059 | A | * | 3/1992 | Ganescu | 52/641 |
| 5,094,285 | A | * | 3/1992 | Murray | 160/67 |
| 5,246,052 | A | * | 9/1993 | Homan | 160/65 |
| 5,259,432 | A | * | 11/1993 | Danieli | 160/66 |
| 5,273,095 | A | * | 12/1993 | Lukos | 160/70 |
| 5,515,655 | A | * | 5/1996 | Hoffmann | 52/126.6 |
| 5,560,411 | A | * | 10/1996 | Becker | 160/67 |
| 5,722,210 | A | * | 3/1998 | Baker et al. | 52/643 |
| 5,794,679 | A | * | 8/1998 | Williams et al. | 160/46 |
| 5,839,462 | A | * | 11/1998 | Randall | 135/128 |
| 5,865,498 | A | * | 2/1999 | Grogan | 296/163 |
| 5,884,647 | A | * | 3/1999 | Dwek | 135/144 |
| 5,890,339 | A | * | 4/1999 | Willis | 52/640 |
| 5,924,465 | A | * | 7/1999 | Malott | 160/67 |
| 5,966,892 | A | * | 10/1999 | Platt | 52/712 |
| 5,983,577 | A | * | 11/1999 | Hays | 52/79.1 |
| 6,000,191 | A | * | 12/1999 | Kessler | 52/745.15 |
| 6,089,306 | A | * | 7/2000 | Frey, Jr. | 160/302 |
| 6,095,221 | A | * | 8/2000 | Frey, Jr. | 160/67 |
| 6,131,638 | A | * | 10/2000 | Levin | 160/80 |
| 6,273,172 | B1 | * | 8/2001 | Frey | 160/67 |
| 6,276,424 | B1 | * | 8/2001 | Frey, Jr. | 160/67 |
| 6,363,664 | B1 | * | 4/2002 | Brutsaert | 52/74 |
| 6,401,422 | B1 | * | 6/2002 | Olden | 52/645 |
| 6,470,632 | B1 | * | 10/2002 | Smith | 52/92.2 |
| 6,488,069 | B1 | * | 12/2002 | Mashaw et al. | 160/67 |
| 6,494,246 | B1 | * | 12/2002 | Blevins | 160/67 |
| 6,519,900 | B1 | * | 2/2003 | Pierce | 52/66 |
| 6,634,152 | B1 | * | 10/2003 | Pilkinton | 52/641 |
| 7,353,855 | B2 | * | 4/2008 | Collishaw | 160/44 |
| 7,832,151 | B2 | * | 11/2010 | Harrisson et al. | 52/66 |
| 2004/0074157 | A1 | * | 4/2004 | Chazal | 52/66 |
| 2006/0237143 | A1 | * | 10/2006 | Collishaw | 160/47 |
| 2009/0014130 | A1 | * | 1/2009 | Heidenreich | 160/66 |
| 2010/0032106 | A1 | * | 2/2010 | Ma | 160/22 |
| 2010/0218906 | A1 | * | 9/2010 | Marzilli et al. | 160/368.1 |

* cited by examiner

MODULAR SHELTER ASSEMBLY

CLAIM OF PRIORITY

The present application is a continuation-in-part application of previously filed, now pending application having Ser. No. 13/216,886, filed on Aug. 24, 2011 incorporated herein by reference in its entirety.

BACKGROUND OF THE INVENTION

1. Field of the Invention

This invention relates generally to the field of structural shelters. More particularly, it concerns structural assemblies with adjustable interconnecting parts.

2. Description of the Related Art

An awning is a secondary covering attached to the exterior wall of a building. Awnings are typically placed above a window, a door, or above the areas along sidewalks. The awning is typically made up of structural components being permanently attached to the exterior wall of the building. Furthermore, the covering for the awning is typically provided by a canvas or plastic sheeting being stretched over the structural components. Traditional awnings are permanently attached to the wall of a building with the covering being stretched permanently in place. Adaptations of awning assemblies have been designed that allow the user to retract or fold certain components of the assembly to partially take down the awning when not in use (e.g. during winter months and/or snowy weather).

If it is desirable to extend an awning farther from a building, then columns are incorporated into the design to provide structural integrity at the far end, thus becoming a canopy. Canopies generally provide increased cover relative to an awning; however, canopies are generally less adaptable with regard to being designed with retractable and/or foldable components.

Generally, both awnings and canopies require a person skilled in woodworking and/or metal working to install the structures. Furthermore, when installed, awnings and canopies are not easily restructured or adapted without uninstalling and reinstalling the components of the structure. Lastly, once the covering on the awning or canopy becomes old or develops cracks or leaks, it may require installation of a completely new structure or a significant tear down of the assembly to make the repairs.

As such, there is a need for a modular system for building awnings and canopies that can be easily adapted for varying uses, that can be easily assembled by the average consumer, and that can be easily repaired.

SUMMARY OF THE INVENTION

The present invention is directed to a shelter assembly comprising a mounting member structured to be secured to a predetermined support, a support beam outwardly spaced from the mounting member and the predetermined support, a plurality of track beams each disposed in interconnecting, supported relation to the mounting member and the support beam, the mounting member, the support beam and the plurality of track beams collectively comprising a modular construction, and the modular construction at least partially defined by an at least initially adjustable interconnecting relation of the plurality of track beams to both the mounting member and the support beam. In some embodiments, the modular construction is further, and at least partially, defined by the connecting assembly being cooperatively structured with the mounting member and the support beam to facilitate a selectively variable spacing between adjacent ones of the plurality of track beams.

In at least one embodiment, the shelter assembly comprises a connecting assembly including at least a first plurality of brackets each disposed and structured to define an adjustable connection of the plurality of track beams to the mounting member. Additionally, the first plurality of brackets may be structured to define a substantially pivotal interconnection of the plurality of track beams to the mounting member. In some embodiments, the first plurality of brackets may also be movably disposed along a length of the mounting member.

In at least one embodiment, the connecting assembly may further include a second plurality of brackets disposed and structured to define an adjustable connection of the plurality of track beams to the support beam. The second plurality of brackets may also be movably disposed along a length of the support beam.

In at least one embodiment, the modular construction is further and at least partially defined by the first plurality of brackets and the second plurality of brackets cooperatively structured with the mounting member and the support beam respectively to facilitate a selectively variable spacing between adjacent ones of the plurality of track beams. In some embodiments, the first and second plurality of brackets may be cooperatively structured with the mounting member and the support beam respectively to facilitate a sliding, adjustable disposition of the first and second brackets along corresponding lengths of the mounting member and the support beam respectively.

In at least one embodiment, the shelter assembly further comprises at least one panel. The panel can be removably connected to and extending along a length of each of adjacent ones of the plurality of track beams. Furthermore, the modular construction of the shelter assembly may be further, and at least partially, defined by the selectively variable spacing substantially corresponding to a transverse dimension of the at least one panel.

In at least one embodiment, the shelter assembly further comprises a stanchion assembly which includes at least one stanchion disposed in supporting relation to the support beam. The modular construction may be further and, at least partially, defined by the at least one stanchion movably connected and selectively positionable along a length of the support beam. In some embodiments, the shelter assembly comprising the at least one stanchion may further comprise a connecting assembly including at least a first plurality of brackets disposed and structured to define an adjustable connection of the plurality of track beams to the mounting member; a second plurality of brackets disposed and structured to define an adjustable connection of the plurality of track beams to the support beam and at least a third bracket disposed in at least initially movable, interconnecting relation between the at least one stanchion and the support beam.

In another embodiment, the shelter assembly comprises a mounting member structured to be secured to a predetermined support with a plurality of track beams each disposed in interconnecting, supported relation to the mounting member. The assembly further comprises a connecting assembly including at least a first plurality of hinged brackets each disposed and structured to define an adjustable connection of the plurality of track beams to the mounting member. Also, the assembly comprises at least one adjustment beam comprising a first end and a second end, the first end structured to be secured to the predetermined support and the second end hingeably and slideably connected to at least one of the plurality of track beams; the mounting member, the at least one adjustment beam, and the plurality of track beams collectively comprising a modular construction, and the modular construction at least partially defined by an at least initially adjustable interconnecting relation of the plurality of track beams to the mounting member and the at least one adjustment beam. As used herein, the predetermined support is generally a wall, such as a wall of a building, or a roof.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
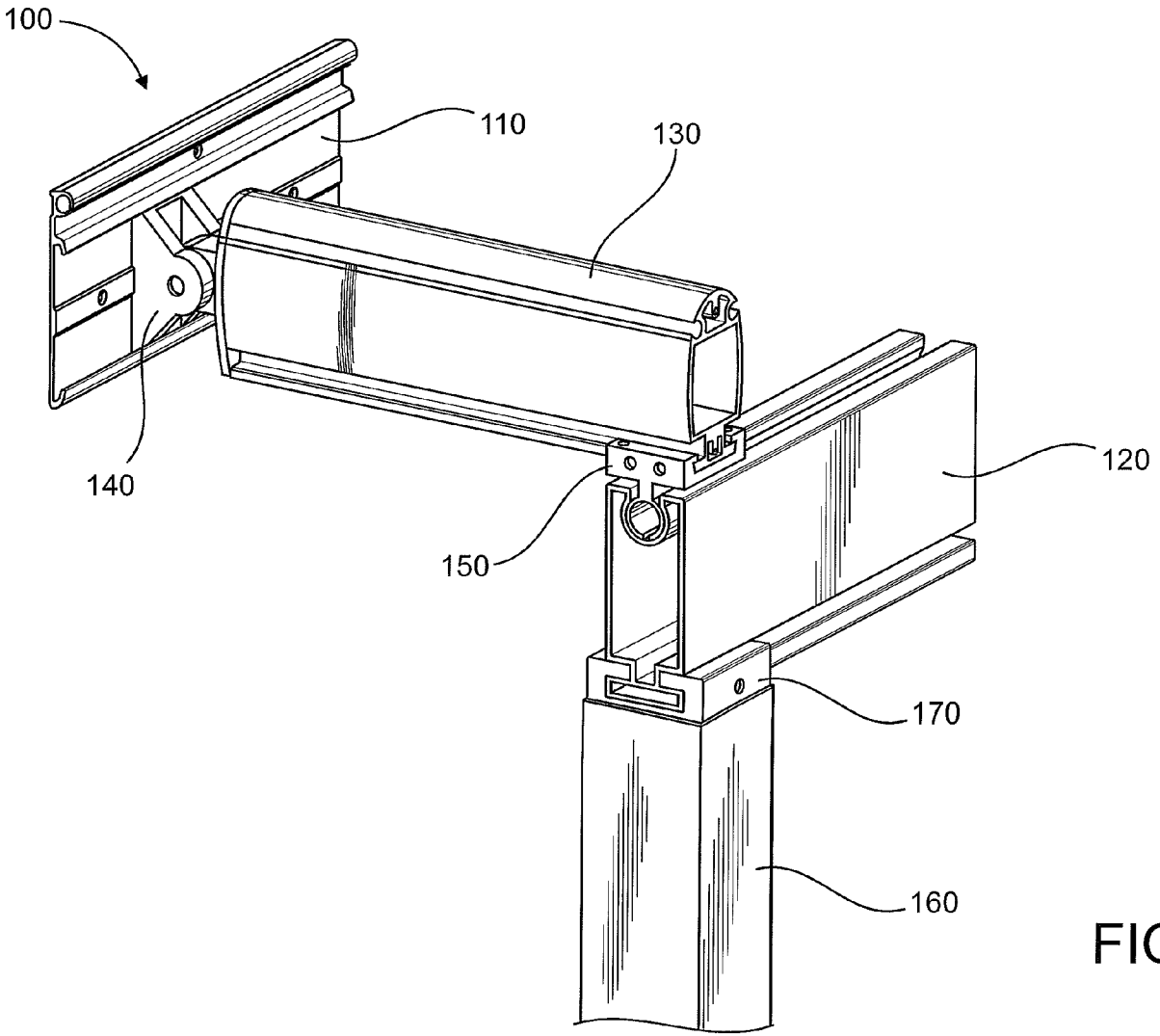
FIG. 1 is a representation of at least one embodiment of the shelter assembly as disclosed in the present specification.

As illustrated in the accompanying drawings, and with primary reference to FIG. 1, the present invention, generally indicated as 100, is directed to a shelter assembly comprising a mounting member structured to be secured to a predetermined support such as, but not limited to an exterior of a building or other supporting structure. A support beam is outwardly spaced from the mounting member and the predetermined support and a plurality of track beams are each disposed in interconnecting, supported relation to the mounting member and the support beam. The shelter assembly described herein is designed such that the average consumer can install/build the assembly with ease and without any specialized tools.

In particular, the present invention is directed to a shelter assembly 100 comprising a mounting member 110 structured to be secured to a predetermined support, a support beam 120 outwardly spaced from the mounting member 110 and the predetermined support, a plurality of track beams 130 each disposed in interconnecting, supported relation to the mounting member 110 and the support beam 120, the mounting member 110, the support beam 120 and the plurality of track beams 130 collectively comprising a modular construction. The modular construction is further and at least partially defined by an at least initially adjustable interconnecting relation of the plurality of track beams 130 to both the mounting member 110 and the support beam 120. In some embodiments, the modular construction is further, and at least partially, defined by the connecting assembly being cooperatively structured with the mounting member 110 and the support beam 120 to facilitate a selectively variable spacing between adjacent ones of the plurality of track beams 130.

In at least one embodiment, the shelter assembly 100 comprises a connecting assembly including at least a first plurality of brackets 140 each disposed and structured to move along a length of the mounting member 110. Therefore an adjustable connection of the plurality of track beams 130 to the mounting member 110 is provided by the first plurality of brackets 140. Additionally, the first plurality of brackets 140 may be structured to define a substantially pivotal interconnection of the plurality of track beams 130 to the mounting member 110. In some embodiments, the first plurality of brackets 140 may also be structured to slide along a length of the mounting member 110. Once disposed in a preferred or intended position, the first plurality of brackets 140 may also include a securing pin or screw to engage the mounting member 110 and hold the first plurality of brackets 140 securely in place.

In at least one embodiment, the connecting assembly may further include a second plurality of brackets 150 disposed and structured to define an adjustable connection of the plurality of track beams 130 to the support beam 120. The second plurality of brackets 150 may also be movably disposed along a length of the support beam 120. The second plurality of brackets 150 may also include a securing pin or screw to engage the track beam 130 and/or the support beam 120, and hold the second plurality of brackets 150 and/or track beam 130 securely in place along a certain position on the support beam 120.

In at least one embodiment, the modular construction is further and at least partially defined by the first plurality of brackets 140 and the second plurality of brackets 150 cooperatively structured with the mounting member 110 and the support beam 120 respectively to facilitate a selectively variable spacing between adjacent ones of the plurality of track beams 130. In some embodiments, the first plurality of brackets 140 and second plurality of brackets 150 may be cooperatively structured with the mounting member 110 and the support beam 120 respectively to facilitate a sliding, adjustable disposition of the first bracket 140 and second bracket 150 along corresponding lengths of the mounting member 110 and the support beam 120 respectively.

In at least one embodiment, the shelter assembly 100 further comprises a stanchion assembly which includes at least one stanchion 160 disposed in supporting relation to the support beam 120. The modular construction may be further and, at least partially, defined by the at least one stanchion 160 movably connected and selectively positionable along a length of the support beam 120. In some embodiments, the shelter assembly 100 comprising the at least one stanchion 160 may further comprise a connecting assembly including at least a first plurality of brackets 140 disposed and structured to define an adjustable connection of the plurality of track beams 130 to the mounting member 110; a second plurality of brackets 150 disposed and structured to define an adjustable connection of the plurality of track beams 130 to the support beam 120; and at least a third plurality of brackets 170 disposed in at least initially movable, interconnecting relation between the at least one stanchion 160 and the support beam 120. The third plurality of brackets 170 may also include a securing pin or screw to engage the support beam 120 and hold the support beam 120 securely in place with respect to the at least one stanchion 160.

Figure 2:
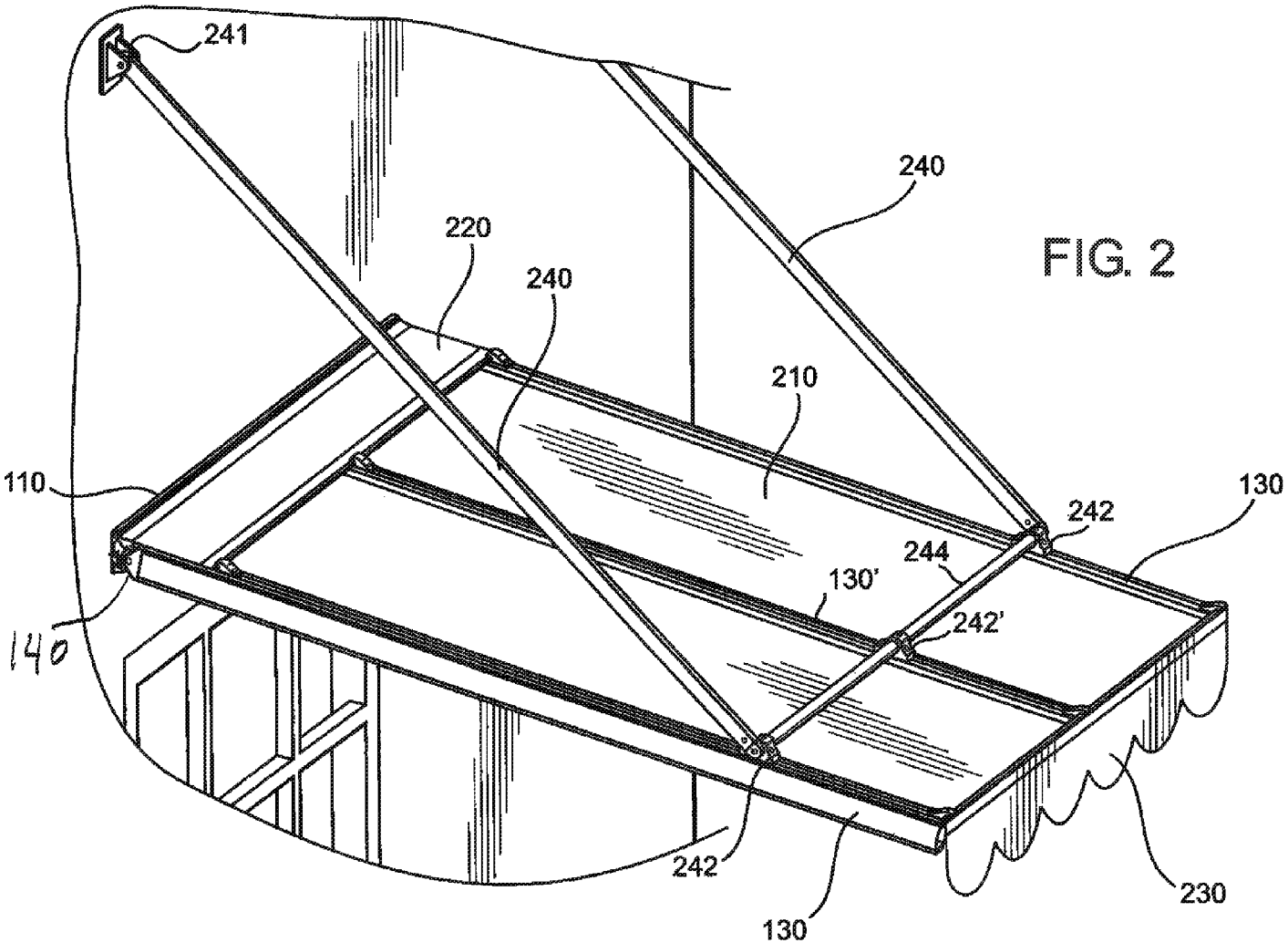
FIG. 2 is a representation of at least one embodiment of the shelter assembly as disclosed in the present specification.

Referring now to FIG. 2, in at least one embodiment, the shelter assembly 100 further comprises at least one panel 210. The panel 210 can be removably connected to and extend along a length of each of adjacently disposed ones of the plurality of track beams 130. Furthermore, the modular construction of the shelter assembly 100 may be further, and at least partially, defined by the selectively variable spacing substantially corresponding to a transverse dimension of the at least one panel 210.

The panels 210 may be in a variety of colors. In some embodiments, each panel 210 is the same color. In other embodiments, each panel 210 may be a different color. In still other embodiments, some panels 210 may be the same color while other panels 210 are different colors. Furthermore, in some embodiments, the panels 210 may be hurricane, or storm, panels (capable of withstanding strong winds of the strength associated with storms or hurricanes). Also, in some embodiments, one or more of the panels 210 may be customized to display indicia such as, but not limited to, one or more printed advertisements or some form of printed or painted artwork on the panels 210. The panels 210 may be constructed of any material suitable for providing cover for shade and/or protection from rain and/or wind. Materials suitable may include, but are not limited to, fabrics, plastics, acrylics, metals, or woods. In a further embodiment, at least one of the panels 210 may be a solar energy panel. The solar energy panels provide an energy source for electrical devices, such as, but not limited to, illumination devices.

In at least one embodiment, the shelter assembly 100 further comprises at least one transverse panel 220 removably connected to and extending along a length of the mounting member 110 and in transverse relation to the lengths of the plurality of track beams 130. Like the one or more panels 210, the at least one transverse panel 220 may be a variety of colors, structured as a hurricane or storm panel, and/or include indicia, displayed advertisements or artwork.

In at least one embodiment, the shelter assembly 100 further comprises at least one transverse end panel 230 removably connected to the outer ends of the plurality of track beams 130 in transverse relation to the lengths thereof. In some embodiments, the at least one transverse end panel 230 may be removably connected to the end(s) of the one or more panels 210. Like the other panels of the shelter assembly, the at least one transverse end panel 230 may include a variety of colors, be structured as a hurricane or storm panel, and/or display advertisements or artwork.

Figure 5:
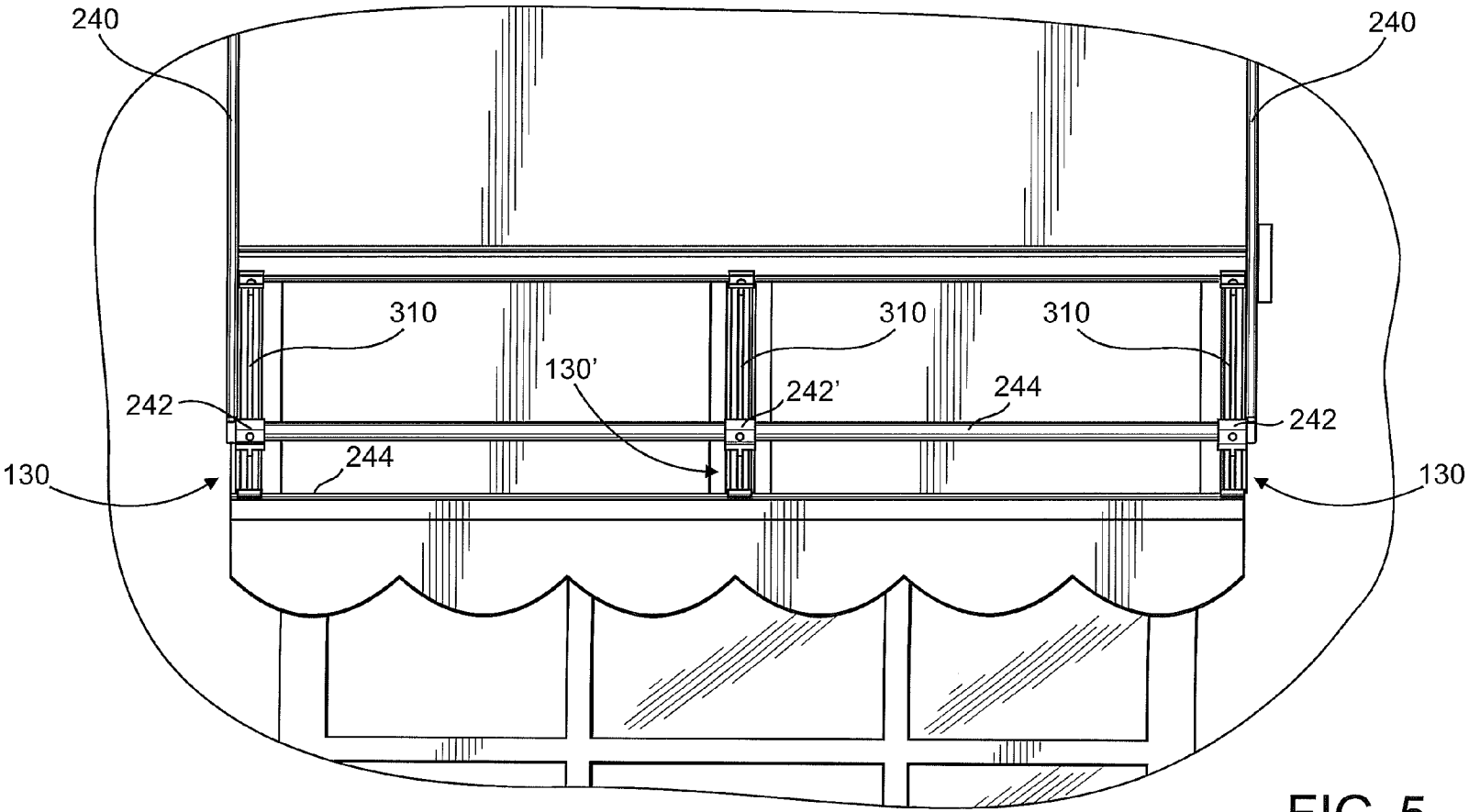
FIG. 5 is a representation of at least one embodiment of the shelter assembly as disclosed in the present specification.

As also represented in the embodiment of FIG. 2, the shelter assembly may further comprise at least one or a plurality of adjustment beams 240 removably and slideably interconnected at a proximal end thereof to the plurality of track beams 130. The other or distal end of the one or more adjustment beams 240 may be mounted to the predetermined support or building structure, wherein the shelter assembly is being used. As represented, distal end(s) may be pivotally connected by a hinge type of connector 241. The slideable and pivotal connection of the proximal ends of the one or more adjustment beams 240, to the plurality of track beams 130 may be accomplished by a corresponding pivotal or hinge connector 242 pivotally connected to the proximal end(s) and linearly movable in sliding engagement with a corresponding track beam channel 310 (see FIG. 6). The interaction of the at least one track beam channel 310 with the one or more adjustment beams 240 is also represented in the embodiment of FIG. 5.

More specifically, each proximal end of the one or more adjustment beams 240 may be hinged/pivotally connected, in addition to being connected to concurrently move linearly or slide along the length of corresponding ones of the plurality of track beams 130 by the connectors 241. This combined pivotal and linear movement allows for adjustment of the shelter assembly and more specifically determines the angular orientation of the plurality of track beams 130 relative to the building or predetermined support to which the shelter assembly 100 is attached. Accordingly, the shelter assembly of the embodiment of FIG. 2 may be used above a window, doorway, walkway, or the like such that the angle of the shelter assembly, specifically including the plurality of track beams 130 can be varied from the orientation of FIG. 2. With further reference to FIGS. 2 and 5, the one or more adjustment beams 240 may be "directly" connected to corresponding ones of the track beams 130. However, an interconnecting relation of the one or more adjustment beams 240 with the plurality of track beams may also be defined and accomplished by the provision of an interconnecting structure 244 having an elongated configuration and extending across each of the plurality of track beams 130 and 130'. Accordingly, as indicated the one or more adjustment beams 240 are not "directly" connected to the track beam 130'. However, by virtue of the interconnecting structure 244 and the pivotally and linearly movable connector 242' the one or more adjustment beams 240 are movably interconnected to the plurality of track beams 130.

As indicated, the one or more adjustment beams 240 may move along the length of the plurality of track beams 130 by the connectors 242 and 242' sliding along the length of the channels 310 so as to be lowered and completely cover the window, doorway, walkway, or the like correspondingly disposed there beneath. Concurrently to the linear movement of the connectors 242 along the length of the track beams 130, the proximal ends of the adjustment beams 240 will also pivot relative to the connectors 242 and the track beams 130. Pivotal movement of the distal ends of the adjustment beams 240 relative to the connectors 241 and the building or predetermined support will also concurrently occur as the angular orientation of the track beams 130 is changed, such as being lowered from their position in FIGS. 2 and 5.

An effective protection of the underlying portal from the sun or rain is thereby accomplished. The one or more adjustment beams 240 allows for variable adjustment of the shading capabilities of the shelter assembly. The capability of completely covering the window, doorway, walkway, or the like, provides a means to close off such areas from damaging winds and/or rain during stormy weather or hurricanes. Furthermore, the one or more adjustment beams 240 may also provide support to the plurality of track beams 130 in the absence of the at least one stanchion 160. In at least one further embodiment, the shelter assembly may be folded completely down and panels readjusted, replaced, and/or removed (as necessary) to provide a shutter next to a doorway, window, walkway, or the like. In such embodiments, the at least one adjustment beam 240 may be removed if desired to provide a more aesthetic and finished look as shutters.

Figure 3:
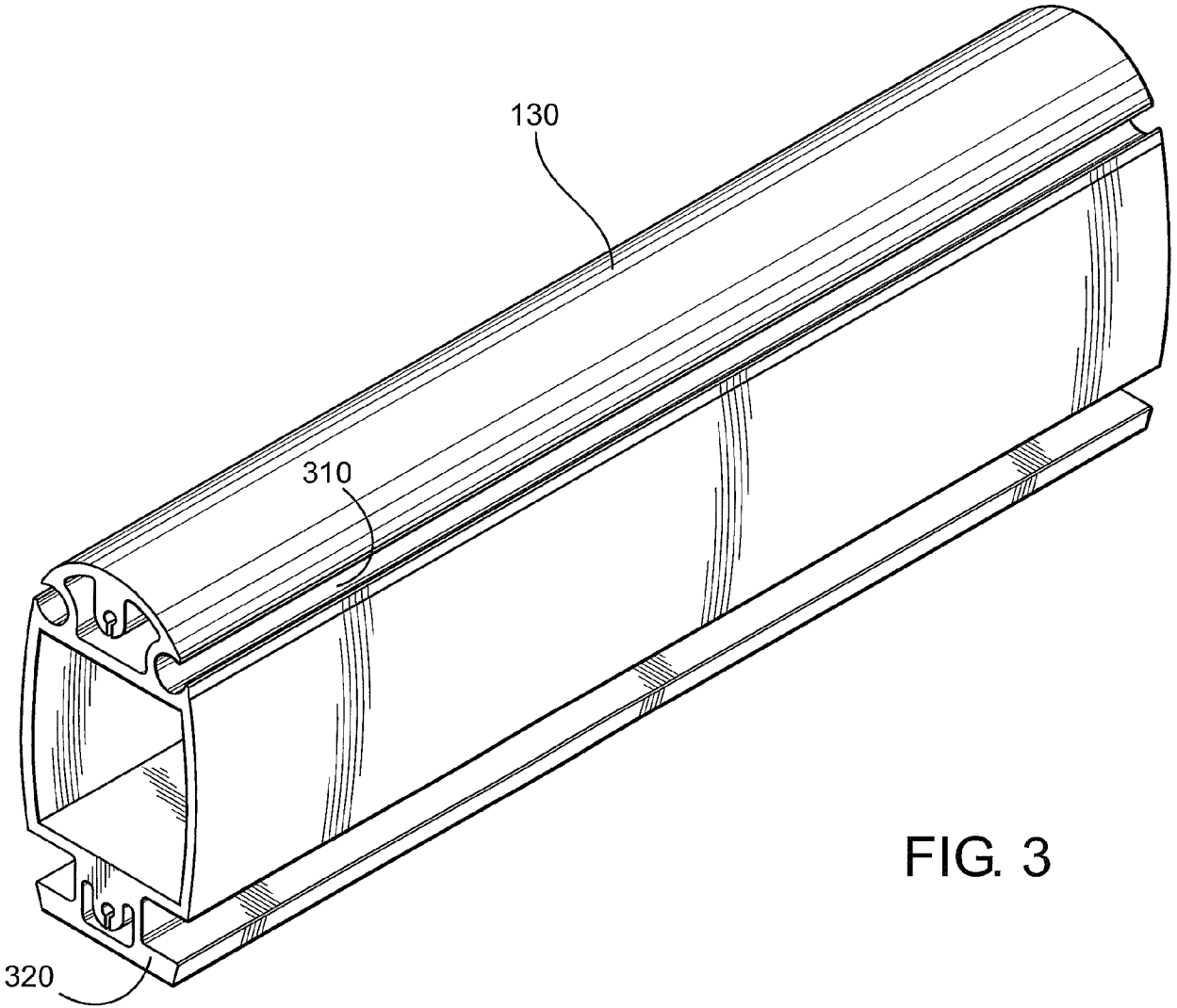
FIG. 3 is a representation of a track beam of at least one embodiment of the shelter assembly as disclosed in the present specification.

Referring now to FIG. 3, in at least one embodiment, the plurality of track beams 130 may further comprise at least one track beam channel 310 disposed along a length of the track beam 130. In some embodiments, the track beam channel 310 is concave in form. As would be understood by those skilled in the art, the track beam channel 310 may comprise a variety of forms that are capable of being removably and adjustably interconnected to a panel. In at least one embodiment, the plurality of track beams 130 may comprise at least one track beam base 320. The track beam base 320 may comprise a variety of forms that are capable of being adjustably interconnected with a bracket, such as the third bracket 170.

Figure 4:
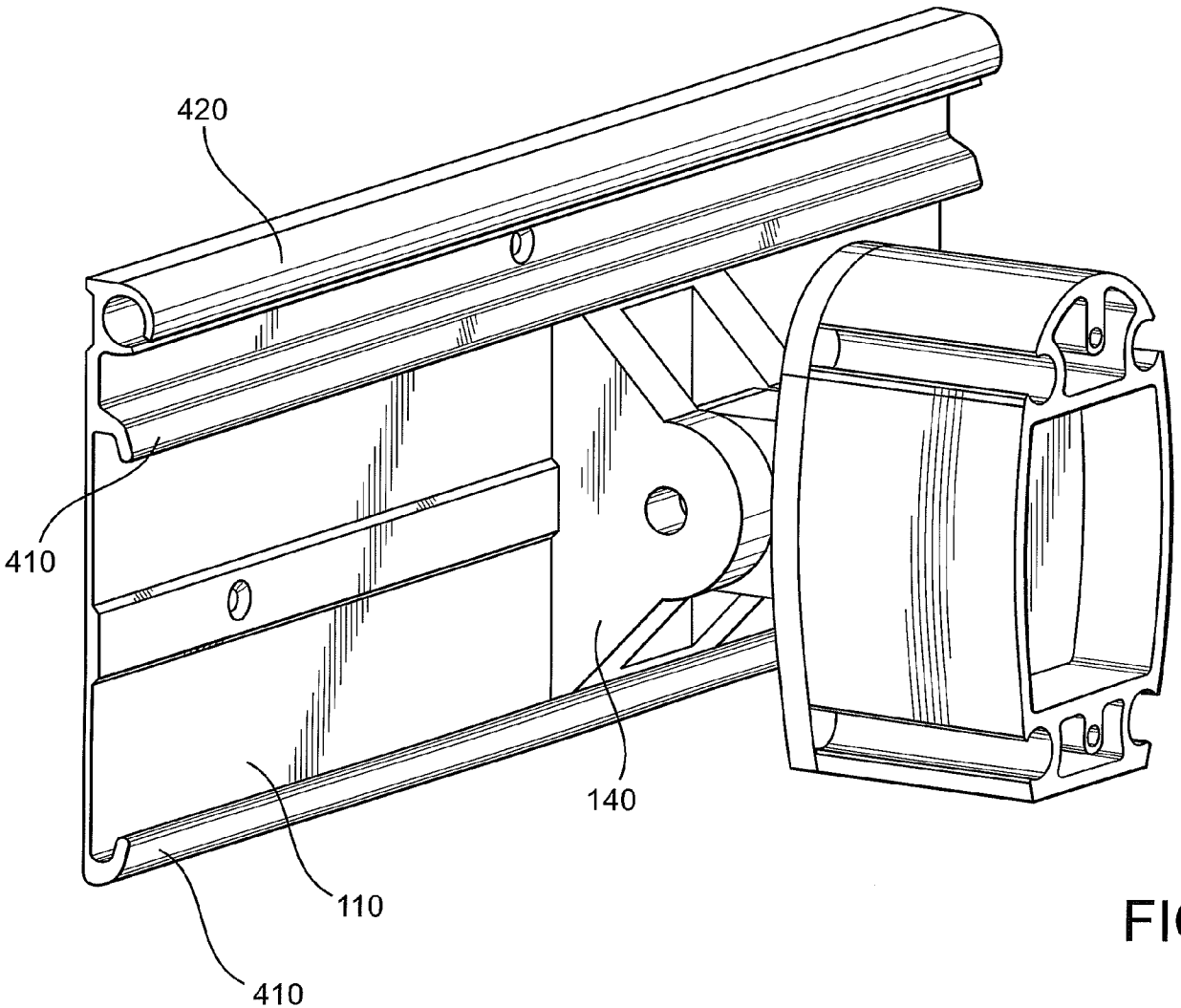
FIG. 4 is a representation of at least one embodiment of the shelter assembly as disclosed in the present specification.

Referring now to FIG. 4, in at least one embodiment, the mounting member 110 may further comprise a plurality of flanges 410 disposed and structured to provide an adjustable connection of the first plurality of brackets 140 to the mounting member 110. As also represented, the mounting member 110 comprises a mounting member channel 420 disposed along a length of the mounting member 110. As would be understood by those skilled in the art, the mounting member channel 420 may comprise a variety of forms that are capable of being removably and adjustably interconnected to at least one transverse panel 220 (see FIG. 2). In a preferred embodiment, the mounting member channel 420 is disposed along a length of the mounting member 110 above the plurality of flanges 410.

Figure 7:
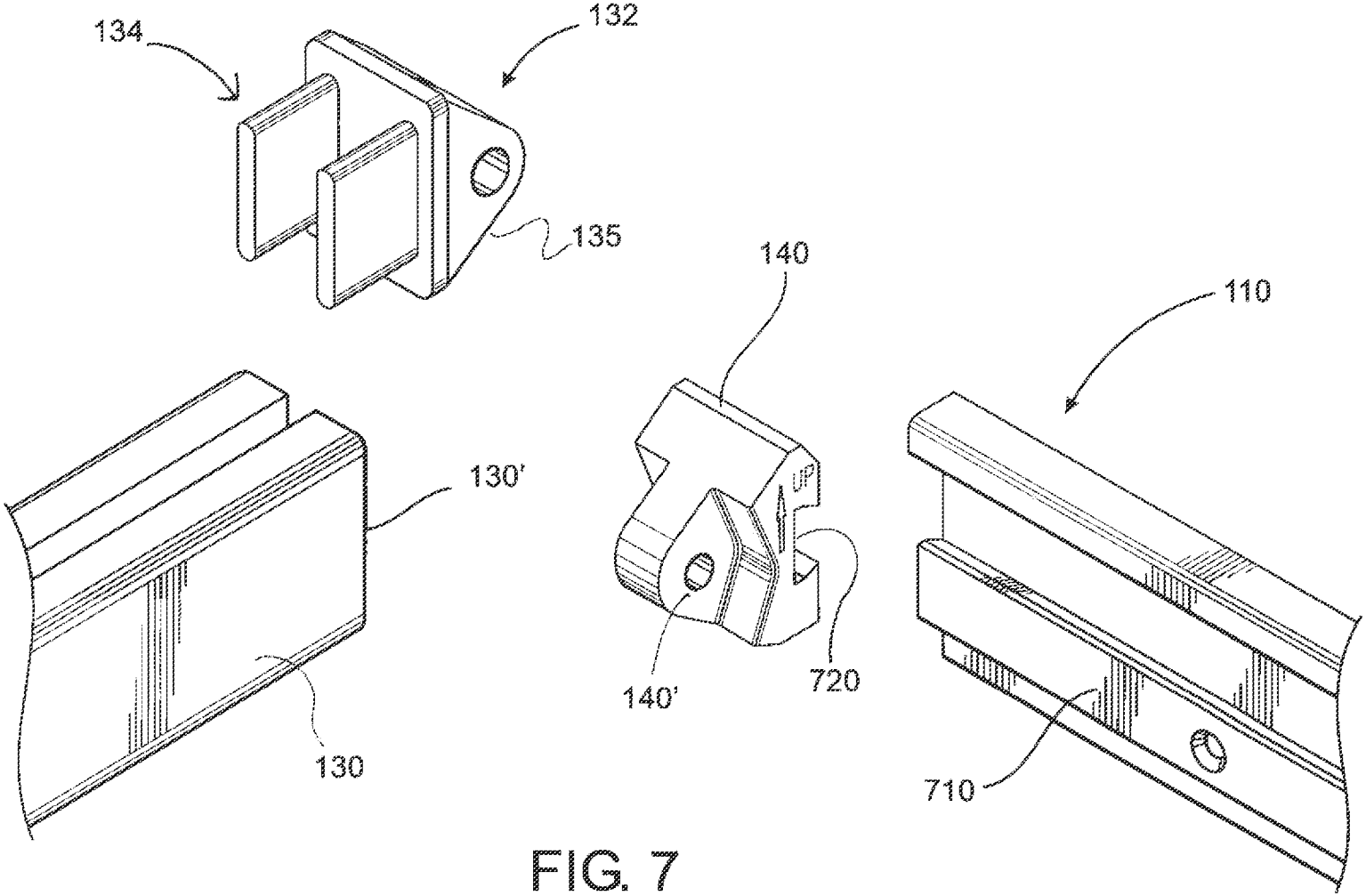
FIG. 7 is a representation of at least one embodiment of the shelter assembly as disclosed in the present specification.

In yet another embodiment, as depicted in FIG. 7, the mounting member 110 may comprise a mounting track 710 which is capable of being slideably and adjustably interconnected with the first plurality of brackets 140 by being movably received within a cooperatively dimensioned and configured recess 720 formed in the brackets(s) 140. As depicted, the first plurality of brackets 140 may be adapted to movably engage or be mounted to slide along the mounting track 710. As also represented in FIG. 7 an end portion 132 may be removably or permanently connected to a corresponding open end 130' of the beam track(s) 130, by an insertion of the segments 134 therein. The hinge structures 135 of the ends 132 and the corresponding hinge structures 140' are cooperatively structured to accomplish the aforementioned hinged connection when operatively aligned and connected by a conventional hinge pin or like structure (not shown).

Figure 6:
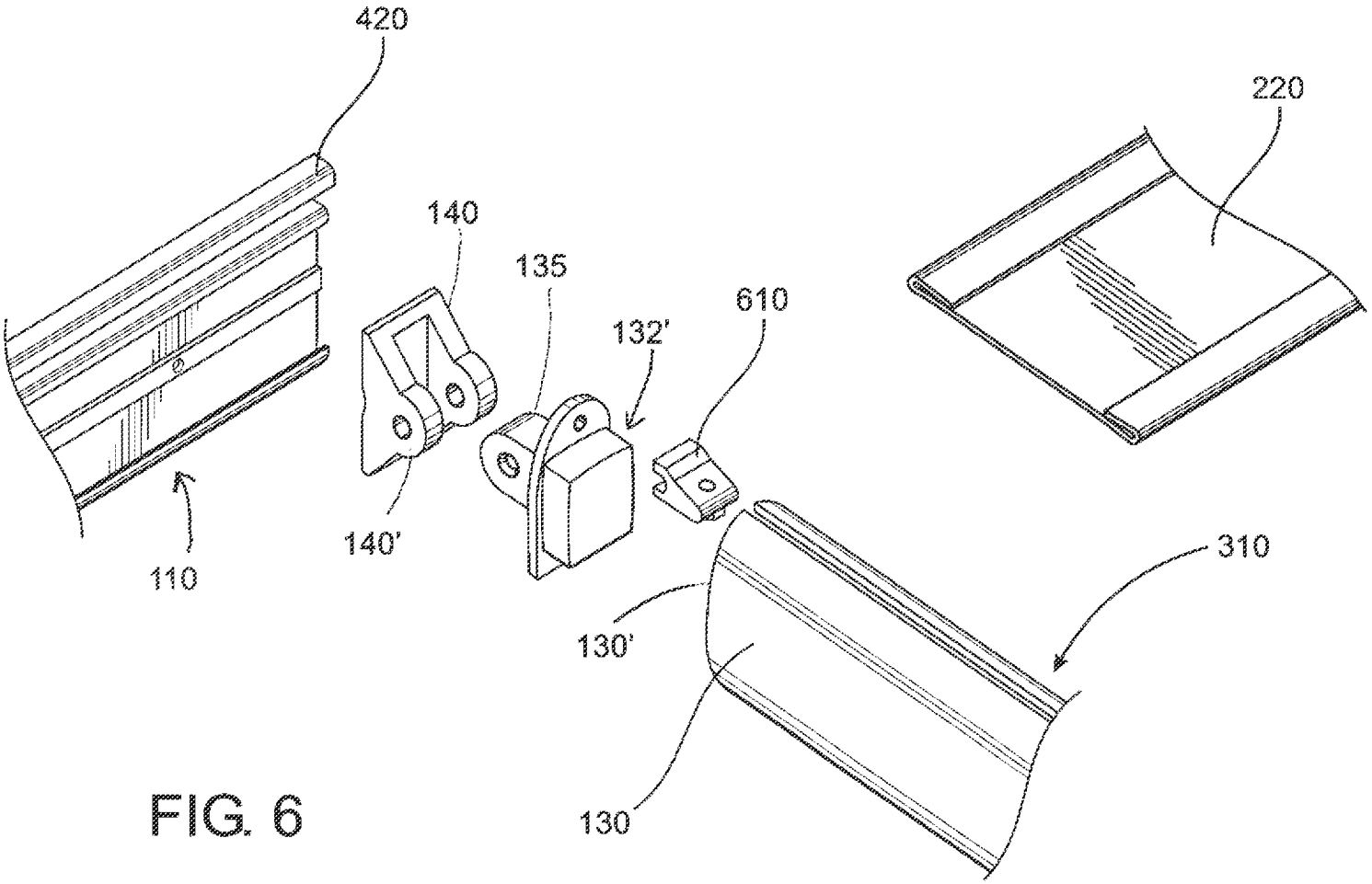
FIG. 6 is a representation of at least one embodiment of the shelter assembly as disclosed in the present specification.

Referring to the embodiment of FIG. 6, the track beam channel 310 of the track beam 130 is adapted to allow attachment of a panel clip 610 which is movably connected and selectively positionable along a length of the track beam 130. The panel clip 610 is configured to allow removable interconnection with a transverse panel 220, thus aiding in the secure interconnection of the transverse panel 220 with the mounting member channel 420. The panel clip 610 may also include a securing pin or screw to engage the track beam 130 and hold the panel clip 610 securely in place. As further represented in FIG. 6 the end 132' may be connected to the open end 130' as described with reference to FIG. 7 and include hinge structure 135 structured to be hinged to the hinge structure 140' of the bracket 140.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A shelter assembly comprising:

a mounting member structured to be secured to a predetermined support, a plurality of track beams connected to said mounting member in spaced relation to one another, a connecting assembly including a plurality of brackets each disposed in adjustable interconnecting relation between said mounting member and different ones of said plurality of track beams, at least one adjustment beam disposed between the predetermined support and the plurality of track beams in at least partially supporting relation to said plurality of track beams, said plurality of brackets and corresponding ones of said track beams movable along a length of said mounting member; said one adjustment beam including a proximal end movably interconnected to said plurality of track beams along a length of the plurality of track beams, a modular construction at least partially defined by an at least adjustable interconnecting relation of said plurality of track beams to said mounting member and said at least one adjustment beam, at least one transverse panel connected to and extending along a length of said mounting member in transverse relation to a length of said plurality of track beams, and said transverse panel being interconnected to and between said mounting member and at least some of said plurality of track beams.

2. A shelter assembly as recited in claim 1 wherein each of said plurality of brackets comprises a hinge structure pivotally connecting corresponding ones of said track beams to said mounting member.

3. A shelter assembly as recited in claim 2 wherein said one adjustment beam is pivotally connected to said plurality of track beams.

4. A shelter assembly as recited in claim 2 wherein said one adjustment beam is pivotally connected to said plurality of track beams concurrent to movement of said proximal end along a length of said plurality of track beams.

5. A shelter assembly as recited in claim 4 wherein said one adjustment beam includes a distal end pivotally connected to the predetermined support.

6. A shelter assembly as recited in claim 1 wherein said one adjustment beam is pivotally connected to said plurality of track beams concurrent to movement of said proximal end along a length of said plurality of track beams.

7. A shelter assembly as recited in claim 1 wherein said modular construction is further and at least partially defined by said connecting assembly cooperatively structured with said mounting member to facilitate selectively variable spacing between adjacent ones of said plurality of track beams.

8. A shelter assembly as recited in claim 7 wherein said plurality of brackets are cooperatively structured with said mounting member to facilitate sliding, adjustable disposition of said plurality of brackets and corresponding ones of said track beams along the length of said mounting member.

9. A shelter assembly as recited in claim 7 further comprising at least one panel removably connected to and extending along a length of adjacent ones of said plurality of track beams; said modular construction further comprising said selectively variable spacing substantially corresponding to a transverse dimension of said one panel.

10. A shelter assembly as recited in claim 1 further comprising a plurality of adjustment beams each moveably interconnected to said plurality of track beams in at least partially supporting relation thereto.

11. A shelter assembly as recited in claim 10 wherein each of said plurality of adjustment beams includes a proximal end moveably interconnected both pivotally and linearly along a length of said plurality of track beams.

12. A shelter assembly as recited in claim 11 wherein an angular orientation of said plurality of track beams is at least partially dependent on a position of said proximal ends relative to the length of said plurality of track beams.

13. A shelter assembly comprising:

a mounting member structured to be secured to a predetermined support, a plurality of track beams adjustably connected to said mounting member in spaced relation to one another, a connecting assembly comprising a plurality of hinged brackets each pivotally interconnecting a different one of said plurality of track beams to said mounting member, said plurality of hinged brackets cooperatively structured with said mounting member to move along a length of said mounting member, at least one adjustment beam connected to the predetermined support in at least partially supporting relation to said plurality of track beams, said one adjustment beam including a proximal end movably interconnected both pivotally and linearly along a length of said plurality of track beams, said mounting member, said at least one adjustment beam and said plurality of track beams collectively comprising a modular construction, at least one transverse panel connected to and extending along a length of said mounting member in transverse relation to a length of said plurality of track beams, and said transverse panel being interconnected to and between said mounting member and at least some of said plurality of track beams.

14. A shelter assembly as recited in claim 13 wherein said one adjustment beam includes a distal end pivotally connected to the predetermined support.

15. A shelter assembly as recited in claim 14 wherein an angular orientation of said plurality of track beams is at least partially dependent on a position of said proximal ends relative to the length of said plurality of track beams.

16. A shelter assembly as recited in claim 13 further comprising a plurality of adjustment beams connected to the predetermined support in at least partially supporting relation to said plurality of track beams, each of said plurality of adjustment beams including a proximal end moveably interconnected both pivotally and linearly along a length of said plurality of track beams.

17. A shelter assembly as recited in claim 16 wherein an angular orientation of said plurality of track beams is at least partially dependent on a position of said proximal ends relative to the length of said plurality of track beams.

* * * * *